United States Patent [19]

Hentges

[11] Patent Number: 4,943,048

[45] Date of Patent: Jul. 24, 1990

[54] STAIRCASE AMUSEMENT SLIDE

[76] Inventor: Judith L. Hentges, 3347 E. Calhoun Pkwy., Minneapolis, Minn. 55408

[21] Appl. No.: 371,980

[22] Filed: Jun. 26, 1989

[51] Int. Cl.[5] ..... A63G 21/02

[52] U.S. Cl. ..... 272/56.5 R; 182/49

[58] Field of Search ..... 272/56.5 R, 56.5 SS; 182/49, 129

[56] References Cited

U.S. PATENT DOCUMENTS

| | | | |
|---|---|---|---|
| 2,270,909 | 1/1942 | Spizer | 182/49 X |
| 3,009,183 | 11/1961 | Lay . | |
| 3,743,281 | 7/1973 | Gimbel | 272/56.5 R |
| 3,796,429 | 3/1974 | Johnston | 272/56.5 R |
| 3,970,300 | 7/1976 | Von Wendt . | |
| 4,220,326 | 9/1980 | Becker . | |
| 4,270,748 | 6/1981 | Ray . | |
| 4,359,781 | 9/1985 | McCoy | 182/49 X |
| 4,498,557 | 2/1985 | Horne . | |
| 4,528,711 | 7/1985 | Packer . | |
| 4,606,431 | 8/1986 | Ruder . | |
| 4,712,264 | 12/1987 | Voith . | |
| 4,773,505 | 9/1988 | Chiba | 182/49 |
| 4,813,663 | 3/1989 | Rice | 272/56.5 R |

*Primary Examiner*—Richard E. Chilcot, Jr.

*Attorney, Agent, or Firm*—Faegre & Benson

[57] ABSTRACT

An amusement slide to be supported in place on a staircase is formed of a plurality of segments which interconnect with modularized connecting means. The slide can be readily and securely assembled into position for use and disassembled for convenient storage. The slide may be varied with a tunnel attachment and a hump segment.

18 Claims, 4 Drawing Sheets

STAIRCASE AMUSEMENT SLIDE

FIELD OF THE INVENTION

This invention provides a staircase slide for children's recreational and exercise use to be supported in place on a pre-existing set of stairs. The slide is formed of a plurality of segments which interconnect with modularized connecting means. The slide may be readily and securely assembled into position for use and may be disassembled for convenient storage. To add to the amusement and play value, the slide may be formed with additional tunnel and hump segments.

SUMMARY OF THE INVENTION

The staircase slide according to the present invention comprises a plurality of modularized interconnecting segments, specifically designed so that the length of the slide is supported along the incline of a set of stairs. At least one slideboard segment is provided having a proximal and a distal terminus at either end along the length of the slide, with the termini provided with modularized connecting means. A terminal segment is provided for positioning at the base of a set of stairs, and is provided with modularized connecting means. The modularized connecting means provide for secure and releasable connection of a distal terminus of a slideboard segment to the proximal terminus of the terminal segment. A plurality of interchangeable slideboard segments of the same or different lengths may be provided to adjust the length of the slide to the length of the incline of the set of stairs. The terminal segment may be provided with means for resisting movement of the slide away from the base of the stairs, such as a means for anchoring to the base of the stairs, carpet gripping means when the floor adjacent the base of the stairs is carpeted, or suction means when the floor adjacent the base of the stairs is a smooth surface. The terminal segment may also be provided with means for retarding forward motion of an object or person descending the slide, such as a slight lift at the distal terminus of the terminal segment along the length of the slide.

The modularized connecting means comprises a connecting engaging means at the proximal terminus of a slideboard segment and a connecting receiving means at the distal terminus of a slideboard segment. Thus, the individual slideboard segments may be interconnected with each other in any desired order to form the length desired. The proximal terminus of the terminal segment is provided with a modularized connecting means for interconnection with a slideboard segment. It is obvious that the proximal terminus of the terminal segment may be provided with either a connecting engaging means or a connecting receiving means.

In addition, an initial segment may also be provided for positioning at the top of a set of stairs. This initial segment has a proximal terminus, to form a proximal terminus of the slide, and a distal terminus, for interconnection with a modularized connecting means on a slideboard segment. The proximal terminus of this initial segment may be formed with a seat means as the proximal terminus of the slide. Again, it is obvious that the distal terminus of the initial segment may be provided with either a connecting engaging means or a connecting receiving means. In order for the initial segment, the slideboard segment(s) and the terminal segment to all be interconnectable with each other, the initial segment must be provided with a connecting engaging means when the terminal segment is provided with a connecting receiving means and vice versa. The initial segment may be provided with means for resisting movement of the slide away from the top of the stairs, such as a means for anchoring to the top of the stairs, carpet gripping means when the floor adjacent the top of the stairs is carpeted, or suction means when the floor adjacent the top of the stairs is a smooth surface.

To further add to the play value of this novel staircase slide, additional segments may also be provided. A tunnel segment may be provided to be releasably attached over the slide. A hump segment may also be provided with the same modularized connecting means as the slideboard segments for interconnection with the modularized connecting means on a slideboard segment, the terminal segment and the initial segment.

DETAILED DESCRIPTION OF THE PREFERRED EMBODIMENT

Figure 1:
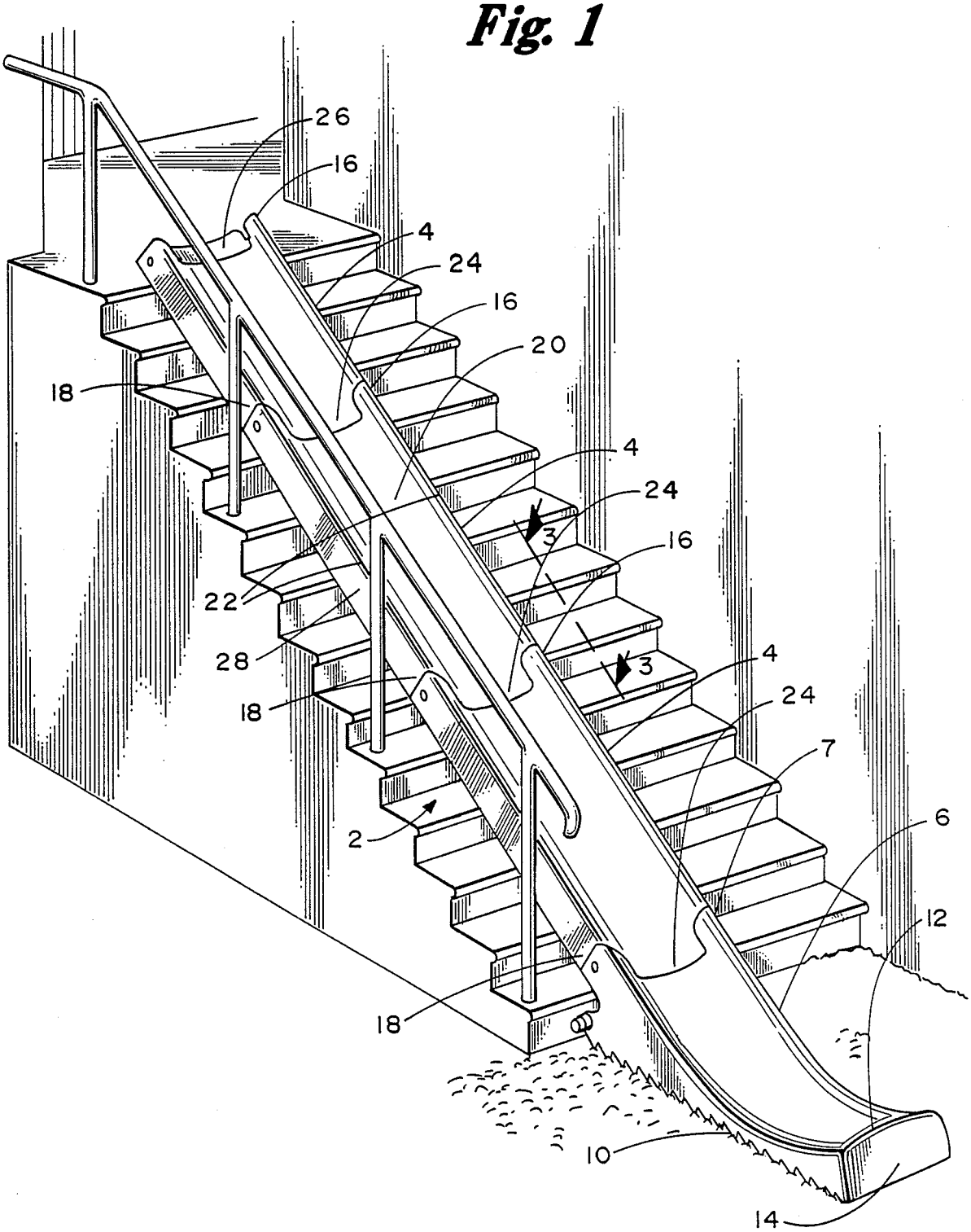
FIG. 1 is a perspective view of a staircase with the present inventive staircase slide in position thereon.
Figure 2:
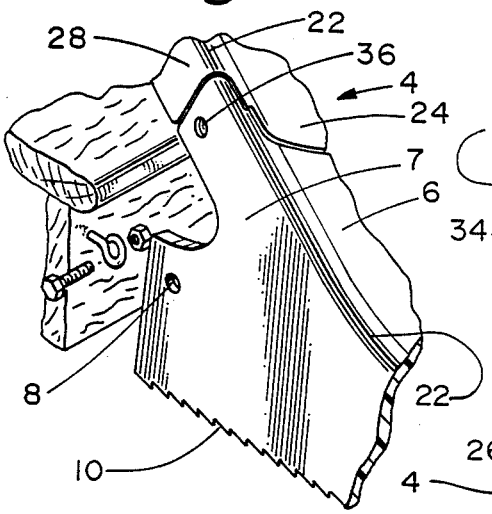
FIG. 2 is an enlarged fragmentary exploded perspective detail of the lower end of the staircase and the inventive slide showing an anchor fastening assembly.
Figure 3:
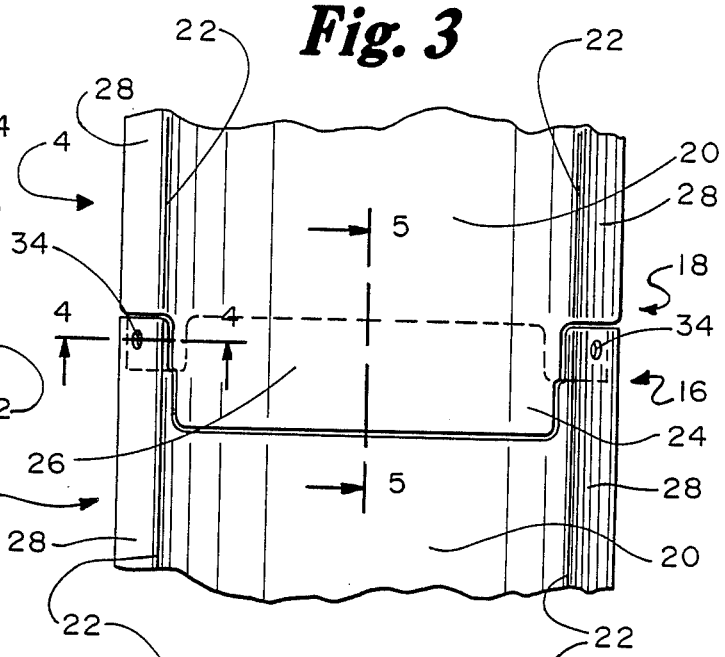
FIG. 3 is a fragmentary auxiliary view taken along line 3—3 in FIG. 1 showing a conjunction between two segments
Figure 4:
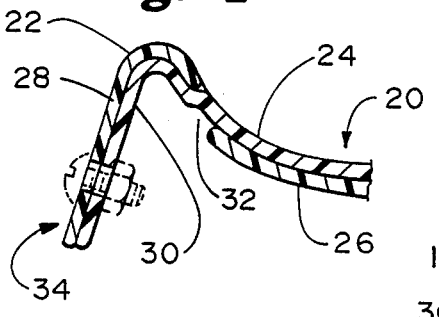
FIG. 4 is an enlarged sectional detail taken along line 4—4 in FIG. 3.
Figure 6:
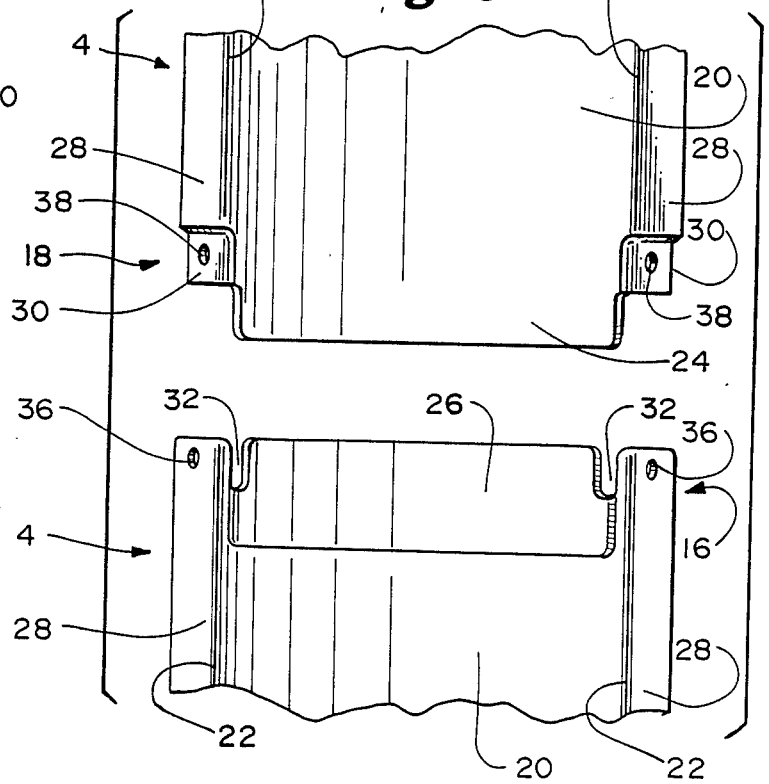
FIG. 6 is a fragmentary exploded auxiliary view similar to that of FIG. 3 with two segments shown slightly separated.
Figure 5:
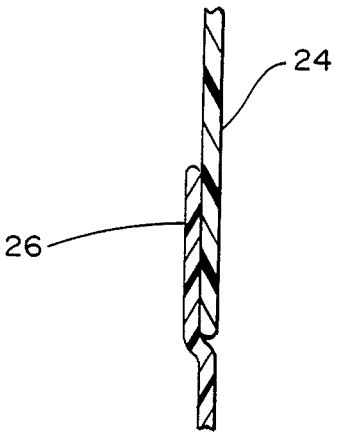
FIG. 5 is an enlarged sectional detail taken along line 5—5 in FIG. 3.

FIG. 1 illustrates a perspective view of an embodiment of an amusement slide 2 of this invention, showing a plurality of slideboard segments 4 and a terminal segment 6 interconnected in position for use on a set of stairs. As shown, the terminal segment 6 is positioned at the base of a set of stairs and the slideboard segments 4 are interconnected therewith supported on the incline of a set of stairs. The terminal segment 6 may desirably be provided at its proximal terminus 7 with means for resisting movement of the slide away from the base of the stairs, shown in FIG. 1 and in the detail of FIG. 2 as an anchor hole 8 which may be secured to a screw eye on the base of the set of stairs, and as carpet gripper teeth 10 to resist sliding on a carpeted floor. Alternatively, if the floor adjacent the base of the stairs is a smooth surface, the terminal segment 6 may be provided with suction cups. The terminal segment 6 may also be provided with means for retarding forward motion of an object or person descending the slide, such as a slight lift 12 at the distal terminus 14.

The proximal terminus 16 and the distal terminus 18 of each slideboard segment 4 and the proximal terminus 7 of the terminal segment 6 are each provided with one part of a two part modularized connecting means. Illustratively, as shown in FIGS. 1–6, the proximal terminus 16 of each slideboard segment 4 and the proximal terminus 7 of the terminal segment 6 are each provided with the connecting engaging means and the distal terminus 18 of each slideboard segment is provided with the connecting receiving means. The slide 2 may desirably be formed with a slightly concave surface 20, as shown in FIGS. 1–6, with upstanding perimeter rails 22, to provide guides for a person descending the slide. Along the concave surface 20, the connecting engaging means is formed with an extending tongue 24 and the connecting receiving means is formed with a recessed tongue relief 26. The flank wall 28 just outside the upstanding perimeter rail 22 on each connecting engaging means is formed with a lap joint recessed relief 30. Just inside the upstanding perimeter rail 22 on each connecting receiving means is a notch 32, so that the flank wall 28 forms a lap joint 34. In connecting engagement, the notches 32 allow the extended tongue 24 to overlap the recessed tongue relief 26 and the lap joint 34 to overlap the lap joint recessed relief 30, as illustrated in FIGS. 1–6. The flank wall 28 adjacent each of the modularized connecting means may be formed with joint holes 36,38 which register with each other when the modularized connecting means are engaged to provide for fastening of the individual segments together if desired for increased rigidity and sturdiness. The extended tongue 24 and the recessed tongue relief 26 as well as the lap joint 34 and the lap joint recessed relief 30 are all designed so that, when the individual segments are interconnected together, the concave surface 20 and the flank walls 28 allow for smooth unobstructed descent of a person or object along the slide 2.

Figure 9:
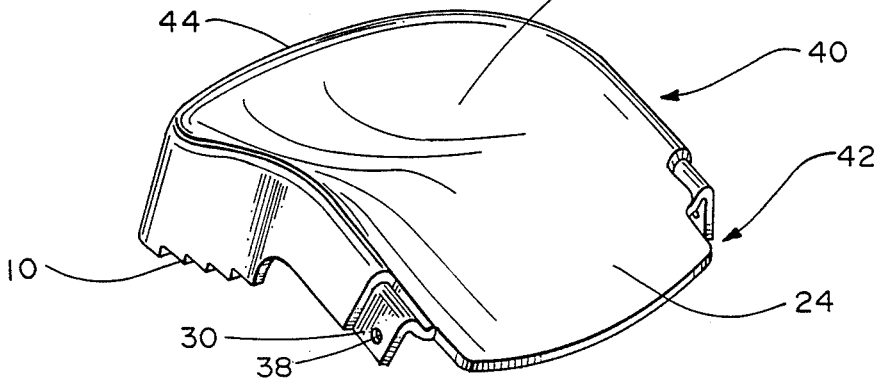
FIG. 9 is a perspective view of an initial seat segment.

The amusement slide 2 of this invention may further desirably comprise an initial segment 40, as shown in FIG. 9, for positioning at the top of a set of stairs. The proximal terminus 42 of the initial segment 40 thus forms the proximal terminus of the slide 2, and the distal terminus 44 of the initial segment 40 is provided with modularized connecting means for interconnection with a slideboard segment 4 or a terminal segment 6. As illustrated in FIG. 9, the distal terminus 42 of the initial segment 40 ma be formed with interconnecting engaging means as described above. The proximal terminus 44 of the initial segment 40 may be provided with a seat 46, such that, when the initial segment is interconnected with a slideboard segment 4, a smooth unobstructed surface is provided for the descent of a person or object along the slide 2. The initial segment 40 may also be provided with means for resisting movement of the slide away from the top of the stairs, such as a carpet gripping means 10, as illustrated in FIG. 9, or a smooth surface suction means, as described above in connection with the terminal segment. The initial segment 40 may also be provided with an anchor hole, not shown, as described hereinabove with reference to the terminal segment in FIGS. 1 and 2, which may be secured to a screw eye positioned, for example, at the top of a set of stairs.

Figure 7:
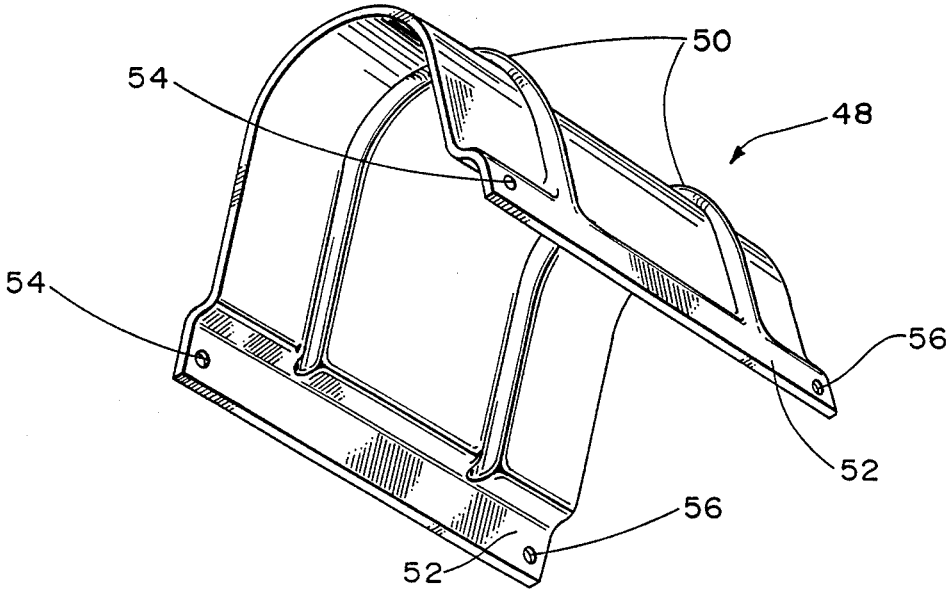
FIG. 7 is a perspective view of a tunnel attachment.

To add to the amusement and play value of the slide 2 of this invention, a tunnel attachment 48 as shown in FIG. 7 may also be provided. The tunnel attachment 48 forms a concave covering over the slide surface, preferably strengthened with reinforcing ribs 50, and having rail covers 52 longitudinally along the sides to overlap the upstanding side rails 22 and flank walls 28 of the slide 2. The rail covers 52 are preferably formed with auxiliary joint holes 54, 56 to provide fastening attachment to the joint holes 36, 38 of the slide segments 4.

Figure 8:
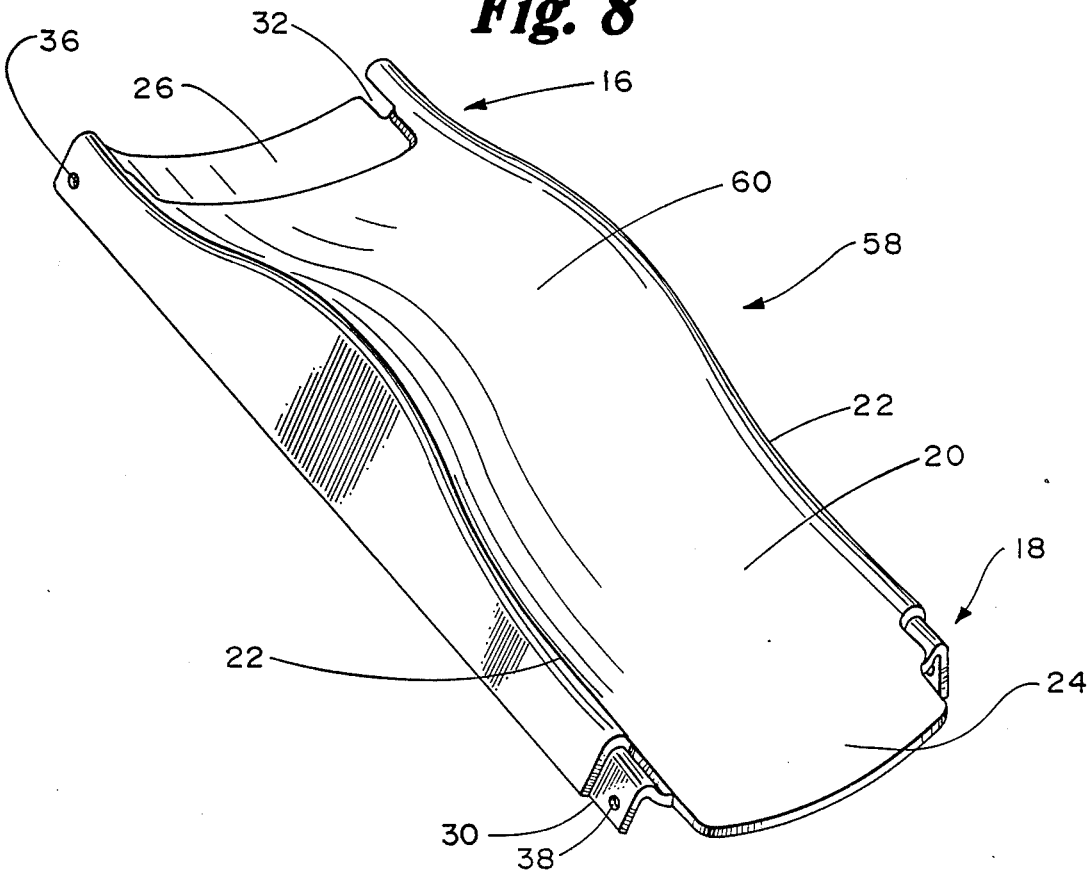
FIG. 8 is an alternate configuration of a segment.
Figure 11:
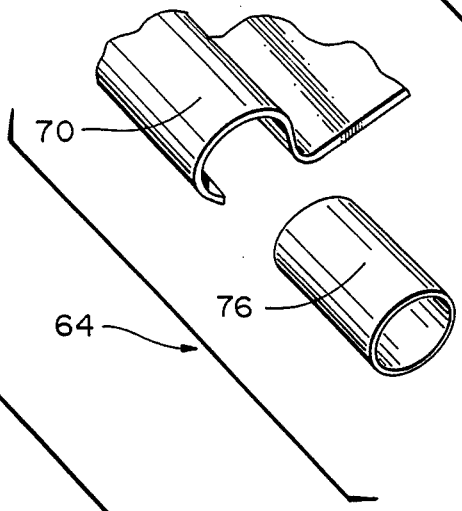
FIG. 11 is an exploded fragmentary view of a second alternate form of interconnecting means.
Figure 10:
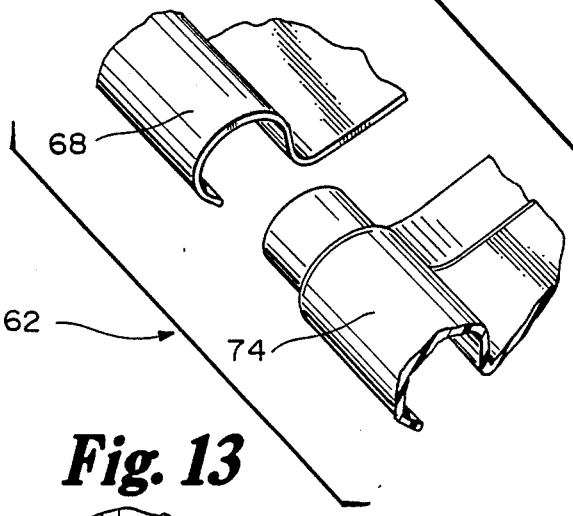
FIG. 10 is an exploded fragmentary view of an alternate form of interconnecting means.
Figure 12:
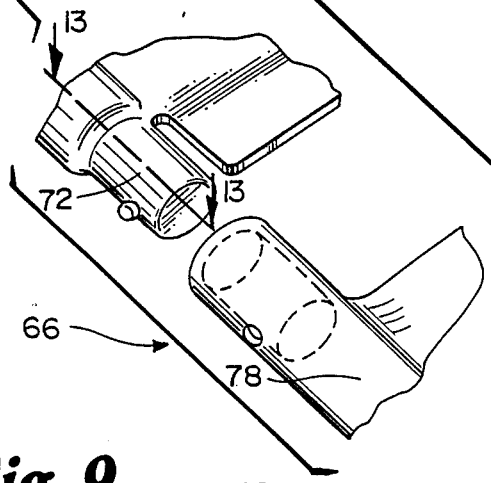
FIG. 12 is an exploded fragmentary view of a third alternate form of interconnecting means.
Figure 13:
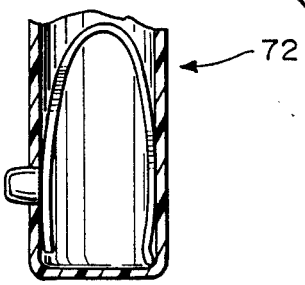
FIG. 13 is a slightly enlarged section taken along line 13—13 of FIG. 12.

The slideboard segments may be formed in various lengths in order to accommodate the slide 2 to staircases of varying heights. An alternative slideboard segment 58, as shown in FIG. 8, may be formed with a hump 60 to provide an alternative interest to the slide 2. As shown in FIG. 8, the alternative slideboard segment 58 is otherwise formed like the previously described slideboard segments.

FIGS. 10 through 13 illustrate other alternate embodiments of two part modularized connecting means 62, 64, 66 with which the slide of the present invention may be formed. As described previously above with reference to FIGS. 1-6, the proximal terminus of each slideboard segment and the proximal terminus of the terminal segment may each be provided with a connecting engaging means 68, 70, 72 and the distal terminus of each slideboard segment and the distal terminus of the initial segment may be provided with the connecting receiving means 74, 76, 78, respectively. As can be readily understood by those skilled in the art, the separate receiving means 76 is used to interconnect identical engaging means 70 on contiguous segments, and thumb depressible button 80 provides additional regidity to connecting means 66. It is to be understood of course that the individual segments may be formed with the interconnecting means in reverse order.

The slide of this invention is preferably molded from a light weight, flexible, chip and break-resistant synthetic resin with sufficient rigidity to withstand extended usage. Although this slide is primarily designed for children's indoor play use, it is obvious that it may also be used for other purposes, such as for emergency escape use, for transportation of items up or down a staircase or whenever an inclined surface for ascent or descent of a staircase may be required.

Having thus described this invention in terms of an illustrative embodiment and in reference to the accompanying drawings, it is not intended that this invention should be limited other than as required by the following claims.

What is claimed is:

1. A staircase slide for use on an incline of a set of stairs comprising:

at least one slideboard segment having a proximal and a distal terminus at either end along the length of the slideboard segment;

a terminal segment having a proximal and a distal terminus at either end along the length of the slide;

the proximal and distal termini of the slideboard segment and the proximal terminus of the terminal segment provided with separable connecting means for securely and releasably connecting a distal terminus of a slideboard segment to the proximal terminus of another slideboard segment, and separately and alternatively, releasably connecting a distal terminus of a slideboard segment to the proximal terminus of the terminal segment;

such that, when the terminal segment is positioned at a base of the set of stairs and the modularized connecting means are releasably connected, the length of the slide is supported along the incline of the set of stairs.

2. A staircase slide according to claim 1, comprising a plurality of interchangeable slideboard segments of independently selected lengths.

3. A staircase slide according to claim 1, wherein the terminal segment is further provided with means for resisting movement of the slide away from the base of the stairs and means for retarding forward motion of an object descending the slide.

4. A staircase slide according to claim 3, wherein the means for resisting movement of the slide away from the base of the stairs comprises means for anchoring to the base of the stairs.

5. A staircase slide according to claim 3, wherein the means for resisting movement of the slide away from the base of the stairs comprises carpet gripping means.

6. A staircase slide according to claim 3, wherein the means for resisting movement of the slide away from the base of the stairs comprises suction means.

7. A staircase slide according to claim 3, wherein the means for retarding forward motion of an object descending the slide is a slight lift at the distal terminus of the terminal segment along the length of the slide.

8. A staircase slide according to claim 1, wherein the modularized connecting means comprises connecting engaging means at the proximal terminus of a slideboard segment and connecting receiving means at the distal terminus of a slideboard segment and the proximal terminus of the terminal segment may be formed with either connecting engaging means or connecting receiving means for interconnection with a slideboard segment.

9. A staircase slide according to claim 1, further comprising an initial segment for positioning at a top of a set of stairs, having a proximal terminus to form a proximal terminus of the slide and a distal terminus for interconnection with a modularized connecting means on a slideboard segment.

10. A staircase slide according to claim 9, wherein the proximal terminus of the initial segment is provided with a seat means as the proximal terminus of the slide.

11. A staircase slide according to claim 9, wherein the initial segment is provided with means for resisting movement of the slide away from the top of the stairs.

12. A staircase slide according to claim 11, wherein the means for resisting movement of the slide away from the top of the stairs comprises means for anchoring to the top of the stairs.

13. A staircase slide according to claim 11, wherein the means for resisting movement of the slide away from the top of the stairs comprises carpet gripping means.

14. A staircase slide according to claim 11, wherein the means for resisting movement of the slide away from the top of the stairs comprises a suction means.

15. A staircase slide according to claim 1, further provided with a tunnel segment releasably attached over the slide.

16. A staircase slide according to claim 2, wherein at least one of the slideboard segments is formed with a hump along the length thereof.

17. A staircase slide for use along the incline of a set of stairs comprising:

an initial segment having a proximal and a distal terminus at either end along the length of the slideboard segment;

a terminal segment having a proximal and a distal terminus at either end along the length of the slide;

the distal terminus of the initial segment and the proximal terminus of the terminal segment each provided with modularized separable connecting means for securely and releasably connecting together;

such that when the terminal segment is positioned at a base of the set of stairs and the initial segment is positioned at a top of the set of stairs, the length of the slide is supported along the incline of the set of stairs.

18. A staircase slide for use on an incline of a set of stairs comprising:

at least two segments, each having a proximal and a distal terminus at either end along the length of the slideboard segment;

at least the proximal terminus of at least a first segment and at least the distal terminus of at least a second segment provided with modularized connecting means for securely and releasably connecting at least the proximal terminus of the first segment to a least the distal terminus of the second segment;

such that, when at least one of the segments is positioned at a base of the set of stairs and the modularized connecting means are releasably connected, the length of the slide is supported along the incline of the set of stairs.

* * * * *